United States Patent [19]

Lanfermann et al.

[11] 4,085,974

[45] Apr. 25, 1978

[54] DRUM CUTTER

[75] Inventors: Willy Lanfermann, Bochum; Friedhelm Henrich, Bochum-Weitmar; Klaus Oberste-Beulmann, Sprockhovel, all of Germany

[73] Assignee: Gebr. Eickhoff, Maschinenfabrik und Eisengiesserei m.b.H., Bochum, Germany

[21] Appl. No.: 780,526

[22] Filed: Mar. 23, 1977

[30] Foreign Application Priority Data

Mar. 25, 1976 Germany ..... 2612671

[51] Int. Cl.[2] ..... E21C 25/08

[52] U.S. Cl. ..... 299/53; 299/42; 299/76

[58] Field of Search ..... 299/42, 43, 89, 80, 299/53, 54, 75, 76, 51

[56] References Cited

U.S. PATENT DOCUMENTS

| | | | |
|---|---|---|---|
| 3,389,755 | 6/1968 | Grant | 299/70 |
| 4,027,918 | 6/1977 | Hujimori | 299/53 |

*Primary Examiner*—Ernest R. Purser
*Assistant Examiner*—William F. Pate, III
*Attorney, Agent, or Firm*—Thomas H. Murray

[57] ABSTRACT

A drum cutter includes a machine body having at the opposed ends, pivot shafts extending parallel to the mine floor at right angles to the direction of travel by the machine body along a coal face. Two support arms each include two laterally-spaced bores at one end thereof to selectively receive a projected portion of a pivot shaft extending toward the mine face. A lever is mounted onto each of the support arms adjacent the bores in the end thereof. A cutter drum projects from the free ends of the support arms at the coal side of the machine body. Hydraulic jacks, supported by the machine body, are coupled to the levers for pivoting the arms to position the cutter drum supported thereby. A motor is supported within a casing attached to the stow side of each support arm. The motor is coupled through gearing to the cutter drum. The projected end of the casing is supported by a bearing member secured to the extension of the machine body and provided with a bore to receive the pivot shaft.

11 Claims, 8 Drawing Figures

DRUM CUTTER

BACKGROUND OF THE INVENTION

This invention relates to a drum cutter including a pivot shaft extending at each end ahead of the machine body parallel with the floor and at right angles to the direction of machine travel for pivotally carrying a support arm having a cutting drum pivotally positioned by pressure jacks while the support arms support a motor on the stow side where the projected end of the motor is carried by means engaging the pivot shaft.

Various forms of drum cutters are known in the art including a drum cutter having at each end a cutter drive motor carried by a pair of support arms pivoted about an axis on the machine body extending transversely to the direction of machine travel. The pair of support arms are located at both sides of the cutter drive motor and enclose the motor between the arms. The cutter drive motors are situated in an exposed and unprotected manner approximately at the height of the cutter drums ahead of the machine body. Pressure jacks used to produce the pivotal motion of the support arms are relatively short and non-symmetrically constructed. These jacks are, therefore, intended for use only at one end of the drum-cutter machine. Because of the externally-disposed prime movers, drum cutters of this kind are particularly easy to repair. The drum cutters have a very short machine member and, therefore, a short structural length. Repairs are made easy because of the relatively small range of pivotal movement by the cutter drums. However, the drum cutters of this type are suitable for use with coal seams of only a medium thickness.

SUMMARY OF THE INVENTION

It is an object of the present invention to provide a drum cutter which is suitable for use with thick coal seams as well as thin coal seams.

According to a further object of the present invention, there is provided a drum cutter wherein a support arm for a cutter drum includes two bores, one above the other, each adapted to selectively receive a single pivot shaft extending transversely to the extended length of the support arm and a pivot lever secured to the same end of the support arm for connection to a pivot jack used to pivot the support arm while carrying a cutter drum extending from the free end thereof toward the mine face.

More specifically, according to the present invention, there is provided a drum cutter to release coal from a mine face while traveling along a mine floor, the drum cutter including the combination of a machine body having a pivot shaft at each of opposed ends thereof, each pivot shaft extends parallel to the mine floor at right angles to the direction of travel by the machine body therealong, two support arms each having two laterally-spaced bores at one end thereof extending transversely to the extended length of the support arm, each bore in the end of each support arm being adapted to selectively receive a pivot shaft at one end of the machine body for pivotal support thereby, a lever releasably mounted onto each of the support arms adjacent the ends thereof having the spaced-apart bores, a cutter drum projecting from the free end of each of the two support arms at the coal side of the machine body for releasing coal from the mine face, jack means supported by the machine body and coupled to a lever on a support arm for pivotal movement to position a cutter drum supported thereby, and motor means supported by each support arm at the stow side, the extended ends of the motor means being coupled to the pivot shafts.

A drum cutter constructed according to the objects and in the above-described manner is operative while the support arms are pivoted about either the top or bottom bores used to selectively receive the pivot shafts. When the support arms are pivoted about the top bores in the support arms, the arms are located downwardly and the ranges of pivotal movement are increased toward the floor whereby the height of the drum cutter is reduced to a dimension defined by the top edge of the machine body. Because the support arms are situated lower and the pivoting range is restricted, the drum cutter is particularly suitable for working thin and medium size coal seams. On the other hand, when the support arms are pivoted about the bottom bores, the support arms are raised. Pivotal movement is shifted upwardly toward the roof at the coal face and the range of pivotal movement is increased so that the drum cutter is usable to release coal from seams up to 3.3 m thickness with the cutting drums. Advantageously, each support arm carries one of several different length pivot levers and the machine body is provided with a pivoting jack selected from pivot jacks having different lengths which act on the pivot levers. The points at which the pivot levers act on the support arms always remains in the operating plane of the pivot jacks. The magnitude of the pivot angle through which the support arms move can be retained by using pivot jacks having an appropriately selected stroke of movement and/or dimensions.

According to another feature of the present invention, the drum cutter is constructed so that, in the plane of motion of the pivot levers, each of the ends of the machine body are provided with a recess adapted to accommodate a pivoting jack. By arranging the pivoting jack in this manner, a portal opening of the machine frame is not restricted so that the height of the frame can be reduced to the amount which is indispensable for the passage of the mined material. This feature is particularly advantageous when drum cutters are used for thin seams and where the machine frame which supports the machine body must be extremely low to provide a drum cutter with a correspondingly low overall height.

The support arms for the drum cutter each include superjacent bores disposed in a mirror-image configuration to the plane of symmetry of each support arm. The pivot lever is attached in one of two positions which are in mirror-image configuration relative to the plane of symmetry of the support arm. When pivot levers are attached to the support arms in positions offset by 180°, both support arms can be mounted on one or the other ends of the machine body. The stockage of spare parts and stores is greatly simplified. Identical support arms can be manufactured in larger numbers, thus reducing the cost.

It is preferred to provide the ends of the support arms with perpendicular recesses such that each recess extends over the height of the support arm and intersects the two bores for receiving part of a pivot lever. Each pivot lever has bores corresponding to the bores in the end of a support arm and retained by inserting the pivot shaft into one of the bores and by inserting a mounting bolt into the other bore. The support arm at the stow side supports a casing having a cylindrical bore which is adapted to accommodate a prime mover typically in the form of a drive motor. The casing is detachably mounted onto the support arm directly adjacent the pivot shaft. The casing is further designed for attachment to a support arm in different positions by rotation of the casing about the axis of its cylindrical bore. The casing is supported at the end which is distal from the support arm by the pivot shaft. The prime movers for both support arms in these casings are accommodated in a flameproof and protected manner. To enable use of each support arm at one or the other ends of the machine body, the casings are detachably mounted onto the support arms at either side and can be attached in different positions by rotation about their bore axes.

Each pivot shaft preferably takes the form of two shaft members mounted in a non-rotatable manner in a common bore formed within an extension of the machine body. The ends of each shaft member project from opposite sides of the extension. One extended end of a shaft member retains a support arm by extending through one of the two bores formed in the arm and into a bore in a lug which is detachably mounted onto the machine body at the working face. The other projected portion of a shaft member retains the prime mover casing by passing into a bore formed in a bearing member which is detachably mounted onto the casing for the prime mover. On the one hand, this arrangement of parts facilitates mounting of the support arm and of the motor casing attached thereto. On the other hand, the arrangement of parts achieves a statically reliable, double-armed and, therefore, particularly resistant manner for support of a support arm.

Longitudinal motions usually imparted to an energy supply cable in the portion thereof extending between the prime mover and the machine body are usually produced by pivoting movement of a support arm. However, according to the present invention, a portion of the energy supply cable extends diametrically through a pivot shaft and guided through a correspondingly extending opening of a retainer which is detachably mounted onto a bearing member covering the bore of a motor casing.

These features and advantages of the present invention as well as others will be more fully understood when the following description is read in light of the accompanying drawings, in which.

Figure 1:
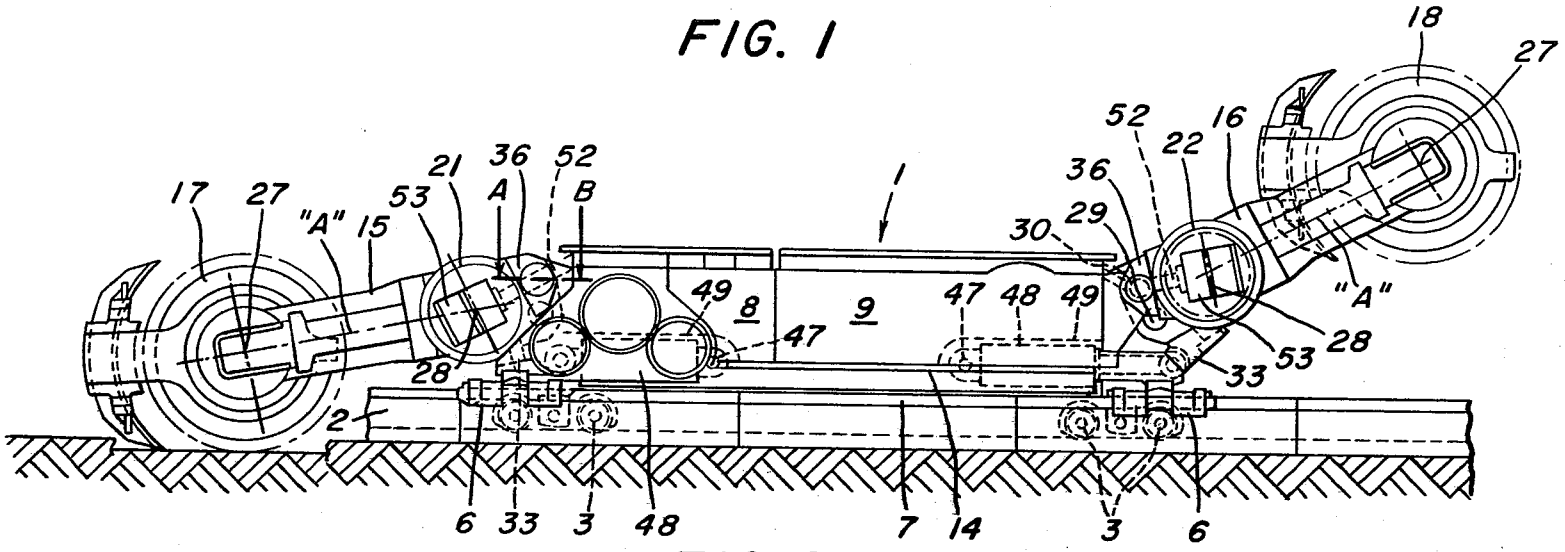
FIG. 1 is a side elevational view of a drum cutter embodying the features of the present invention.
Figure 2:
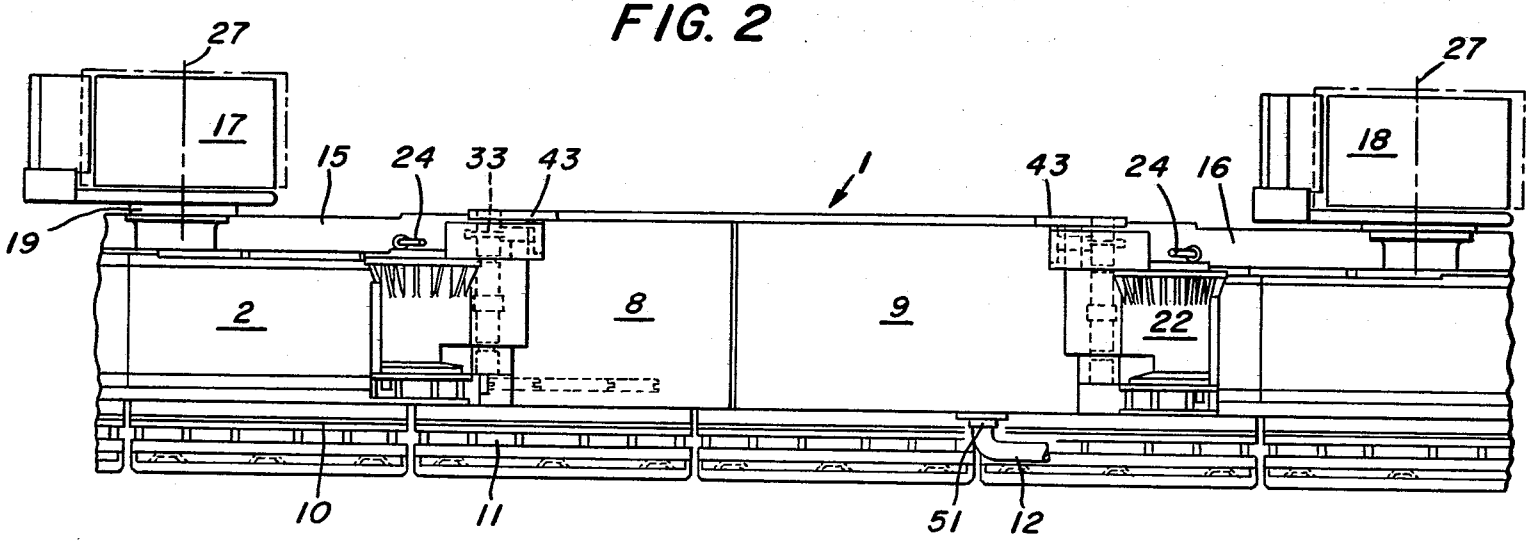
FIG. 2 is a plan view of the drum cutter shown in FIG. 1.
Figure 3:
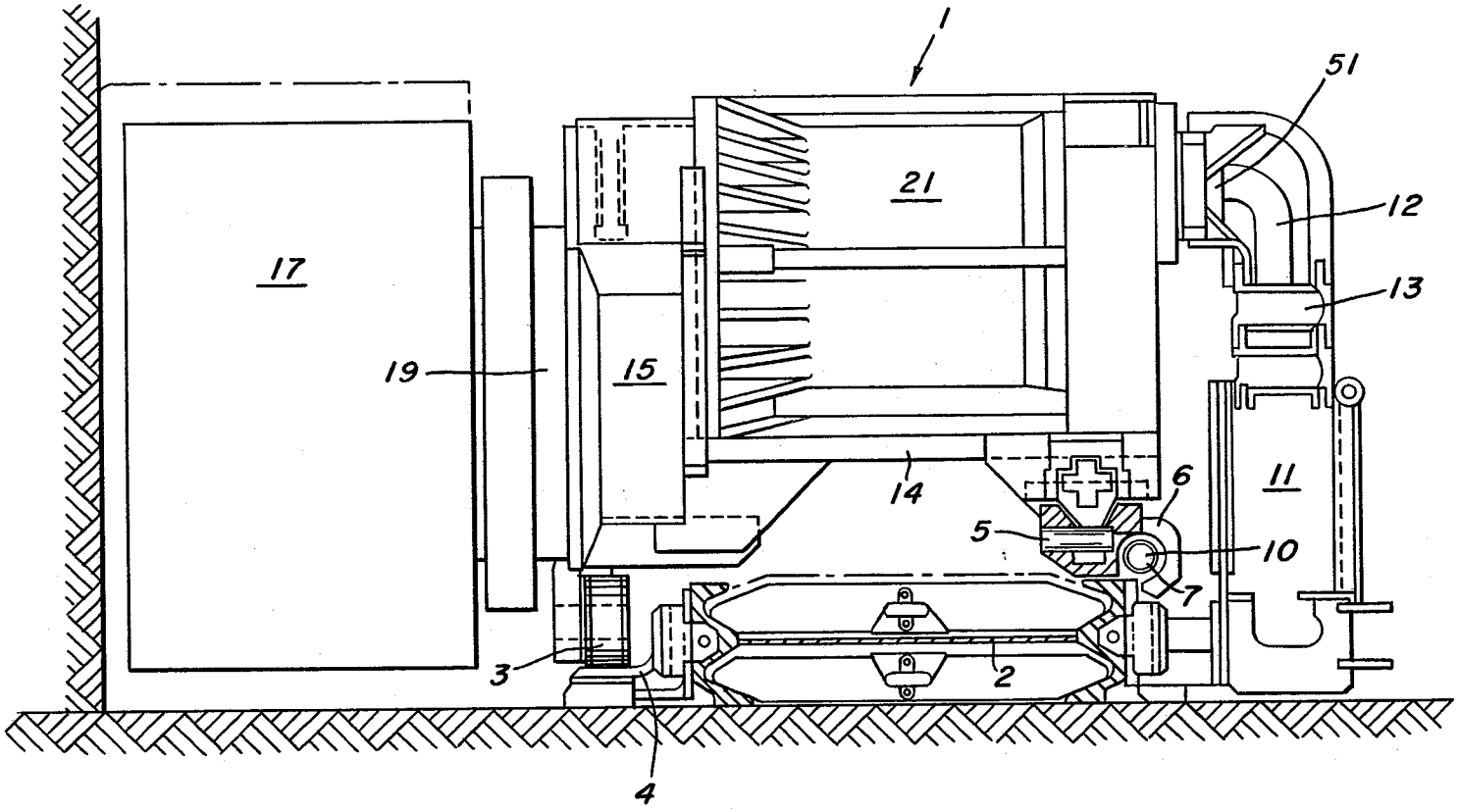
FIG. 3 is an end elevational view of the drum cutter shown in FIG. 1.
Figure 4:
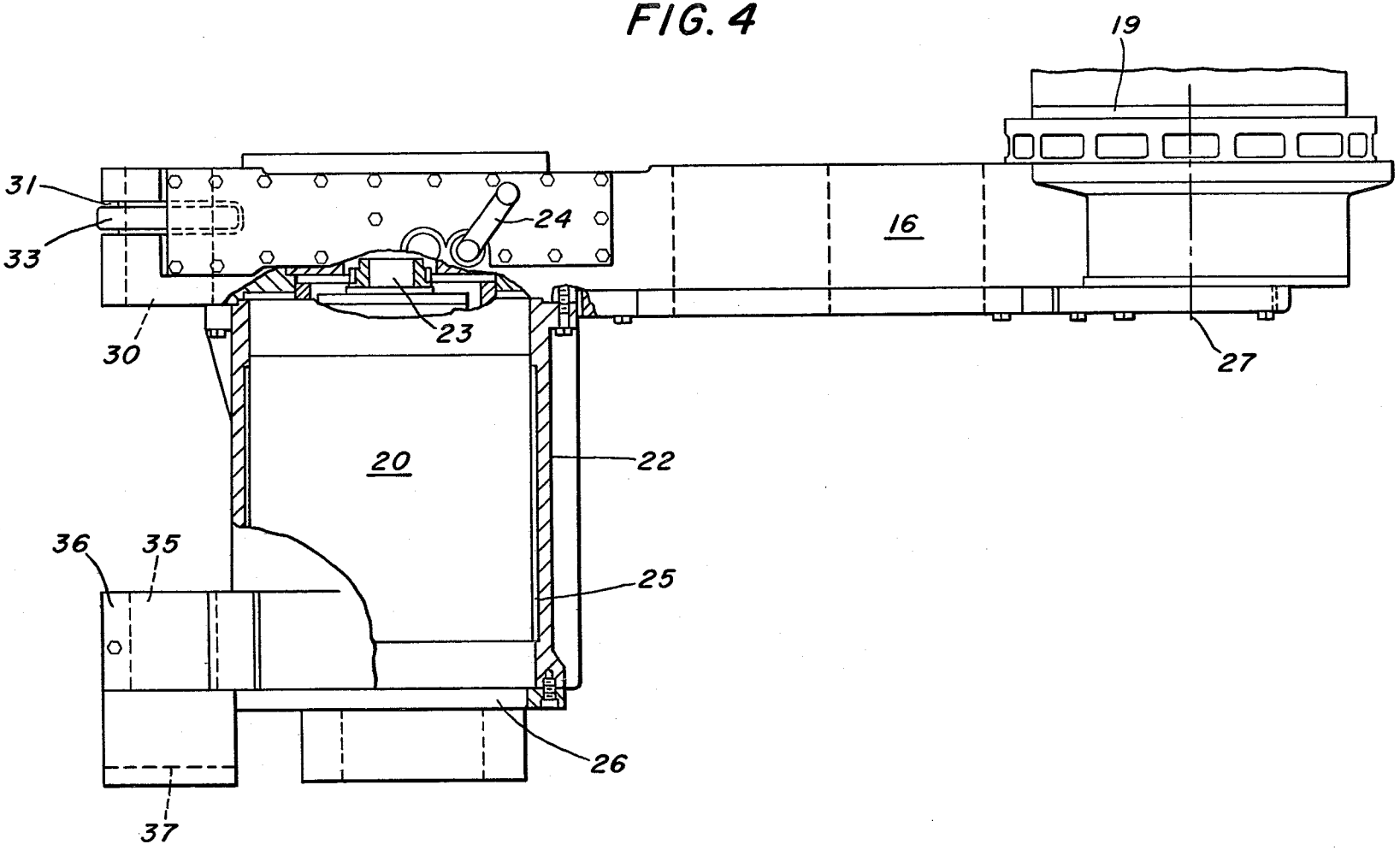
FIG. 4 is an enlarged plan view, partly in section, of a support arm for the drum cutter of the present invention.

In FIGS. 1–3, there is illustrated a drum cutter 1 adapted for transverse movement along a face conveyor 2. At the working face side of the drum cutter, roller skids 3 bear on a ramp 4 which is mounted onto the face conveyor 2. On the stow side of the drum cutter, sliding skids 5 bear on a trough section of the face conveyor 2. Extensions 6 to the sliding skids 5 at the stow side of the drum cutter grip around guide rail 7 on which the drum cutter is guided. The drum cutter further includes a winch 8 and a housing 9 which are rigidly bolted to each other to form a machine body. A drive sprocket wheel and two reversing wheels of the winch 8 engage a round-link chain, not shown, stretched along the entire length of the mine face, but spaced outwardly therefrom at the stow side of the drum cutter. A side bracket 10 on the face conveyor 2 closes the working zone at the stow side. The side bracket is provided with a cable duct 11 for accommodating the cable chain which surrounds and protects a cutter cable 12. A machine frame 14 supports the machine body. The skids 3 and 5 are mounted onto the working face side and the stow side, respectively, of the machine frame 14. Support arms 15 and 16 carry, at their outer ends, cutter drums 17 and 18, respectively. A casing 19 is supported at the outer end of each support arm. The casing is located coaxially with the rotational axis of a cutter drum. The casing is constructed to project into the base of a cutter drum and accommodates a reducer transmission.

The support arms 15 and 16 at their ends opposite the cutting drums in the regions nearest the machine body are each provided with a prime mover 20 typically a drive motor extending transversely to the direction of travel by the drum cutter. The prime mover 20 is mounted onto the wall of the support arm at the stow side and located within a cylindrical casing 21 in regard to support arm 15 and a cylindrical casing 22 in regard to support arm 16. As best shown in FIGS. 2–5, the cylindrical casings 21 and 22 are stiffened by peripheral ribs attached to the outer surface thereof. A stub shaft 23 of the prime mover 20 engages transmission gearing carried by the support arms. A clutch, not shown, couples the prime mover 20 to the transmission gearing and disengages the prime mover from this gearing. The clutch is operated by a lever 24.

The casings 21 and 22 are flange-mounted onto the support arms 15 and 16, respectively, and centered within a machined recess in the support arms. The prime movers are located within a cylindrical bore 25 of the casing. A rear flange 26 closes the bore 25 of the casing in a tightly-sealed manner. The flange 26 for each casing is secured by bolts. Each support arm 15 and 16 is substantially symmetrical relative to a plane A (FIG. 1) which is defined by a plane passing through the rotational axis 27 of the cutter drum and the rotational axis 28 of the prime mover 20. Plane A is substantially symmetrical relative to the end of each support arm which projects beyond the rotational axis 28 of the prime mover toward the machine body. In this projected end of each support arm, there is provided superjacent bores 29 and 30 arranged in a mirror-image configuration with respect to plane A. A recess 31 extends over the entire height of each support arm 15 and 16 and subdivides the two bores 29 and 30 into two longitudinal sections. Each of the bores receives a bushing 32 which extends along the length of each subdivided bore. The bushings 32 are detachably disposed in the bores to retain a pivot lever 33 which extends into the recess 31 where the lever is provided with two bores corresponding in dimension and spacing to bores 29 and 30 to receive bushings 32 inserted therein.

Threaded fasteners 34 are used to detachably connect the pivot levers to each of the support arms 15 and 16. A bore 35 corresponding to the bore 30 in a support arm, if formed in a bearing member 36 that is secured to each of the casings 21 and 22. More specifically, the bore 35 in bearing member 36 is coaxial with bore 30 in each of the support arms according to the embodiment illustrated in FIGS. 1–7. A bearing member 36 is detachably mounted onto each of the projected ends of casings 21 and 22 at the stow side of the arms. Each bearing member supports in a detachable manner a retaining member 37 which covers the bore 35 in the bearing member 36.

Figure 6:
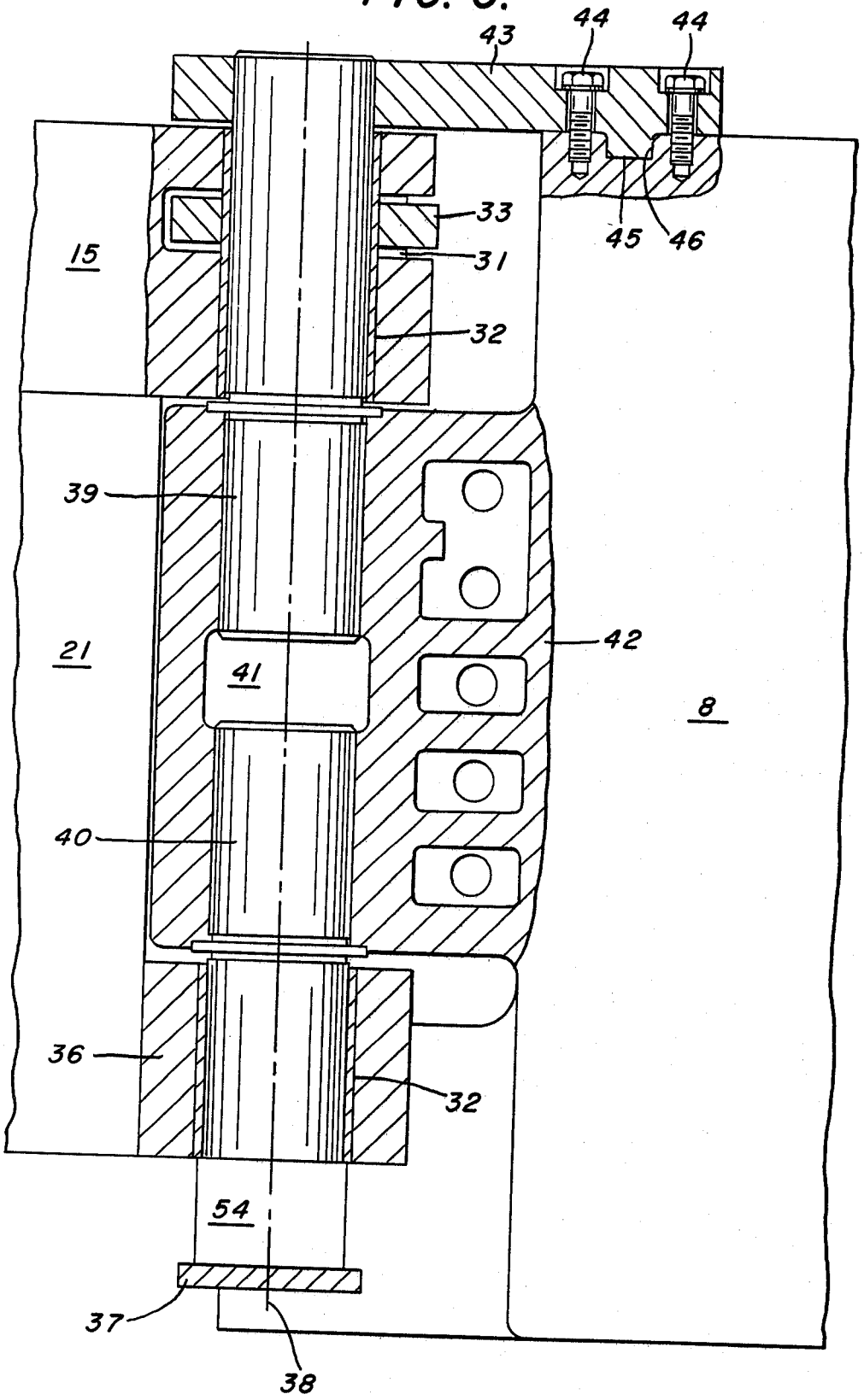
FIG. 6 is a partial sectional view taken along line A–B of FIG. 1.

As shown in the drawings, the two ends of the machine body for the drum cutter 1 are provided with structural components including support arms 15 and 16, casings 21 and 22, and prime movers 20. These components are supported for pivotal movement about a horizontal axes 38 which are oriented at right angles toward the working face. Each axis 38 extends coaxially with the longitudinal axis of a pivot shaft which is actually formed by two shaft members 39 and 40 in a common bore 41 located in an end extension 42 of the winch 8 and in an end extension 42 of casing 9. The shaft members 39 and 40 are retained by keeper plates or the like in the common bore 41 while end portions of shaft members 39 and 40 project toward the working face side and the stow side, respectively, of the drum cutter. The support arms 15 and 16 are mounted onto the projected ends of shaft member 39 at each end of the drum cutter. The projected ends of shaft members 40 at the stow side at each end of the drum cutter are received into bores 35 of the bearing members 36 which are secured to the casings 21 and 22. A lug 43 is mounted onto the wall surface of winch 8 or casing 9 at the working face side by screw fasteners 44. A nose 45 extends from lug 43 into positive engagement with a recess 46 in the support wall. The lug 43, as shown in FIG. 6, has a bore adapted to receive the terminal end portion of shaft member 39 to retain pivot arm 15 on the shaft member. The lug 43 for each support arm 15 and 16 not only secures the support arms onto shaft members 39 but also provides a load support since it functions as a bearing for the outer terminal end portion of the shaft member.

A jack 48 is located within a recess 49 in casing 9 and in a recess 49 in winch 8. The jacks 48 are pivotal about shafts 47 when moving the support arms 15 and 16 into operating positions. The jacks typically in the form of piston and cylinder assemblies are coupled at their rod ends to ends of the pivot levers 33 porjecting downwardly from recesses 31 in the support arms 15 and 16.

Figure 7:
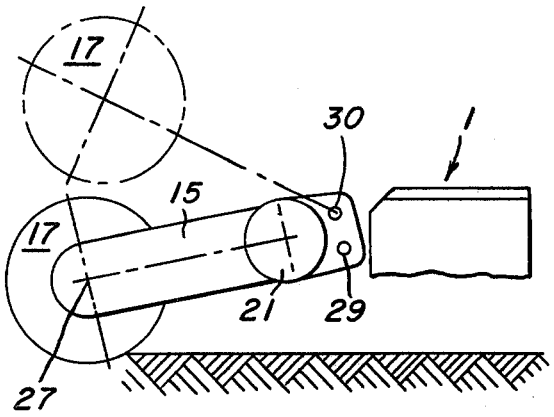
FIG. 7 is a diagrammatic view of a support arm pivoted about the top bore of two superjacent bores in a support arm.

When the drum cutter 1 is employed to release coal from a thick coal seam as well as a coal seam having a medium thickness, it is supported upon a machine frame 14 having a height which is adapted to the thickness of the coal seam to be worked. In the embodiments illustrated in FIGS. 1–7, the range of pivotal movement for cutting drums 17 and 18 is restricted to medium thicknesses of coal seams up to approximately 2.3 meters given a cutter drum diameter of 1100 millimeters. The pivot jacks 48 are constructed so that they have a length of stroke which is sufficient for providing the necessary pivot range to the cutter drums. By locating the pivot jacks in recesses 49 within the winch 8 and casing 9, the pivot jacks do not restrict the head room of the relatively low frame 14. In this embodiment, the top bores 30 in each of the two support arms 15 and 16 receive the shaft members 39 forming the pivot axis 38. In the horizontal position, the support arms do not, therefore, project upwardly beyond the machine body. This arrangement of parts is best shown in FIG. 7. Pivot levers 33 employed to interconnect jacks 48 and the support arms 15 and 16 are, therefore, provided with a relatively short length so that the pivot jacks 48 with a relatively short length of stroke and constructed with a relatively short overall length are sufficient to move the cutter drums 17 and 18 into their top working position. Since the pivot jacks 48 are always accommodated within recesses 49 in the machine body, the lengths of which are defined by the structural length of the winch 8, they do not restrict the portal opening in the machine frame which is in any case low when working thin seams.

Figure 8:
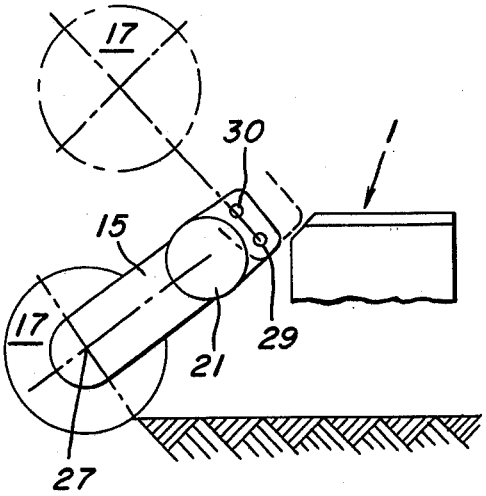
FIG. 8 is a diagrammatic view of a support arm pivoted about the bottom bore of two superjacent bores in a support arm.

When the drum cutter is employed to work thick seams, the bottom bores 29 in the support arms 15 and 16 receive the shaft members 39 forming the pivot axis 38. As illustrated in FIG. 8, the support arms project upwardly beyond the machine body. A machine frame 14 having a greater height is used when working thick seams. The jacks 48 have a larger physical size in this instance and they are not totally received within recesses 49 because of their length. The jacks 48 are accommodated only within the frame portal and they are coupled to pivot levers 36 by pivot pins 50 which are located at a greater distance from the pivot axis 38 of the support arm as compared with the arrangement of parts used for working thin seams. However, when working thick seams, the range of pivotal movement is increased by increasing the magnitude of movement o the support arms 15 and 16 by fully utilizing the longer stroke of jacks 48.

Figure 5:
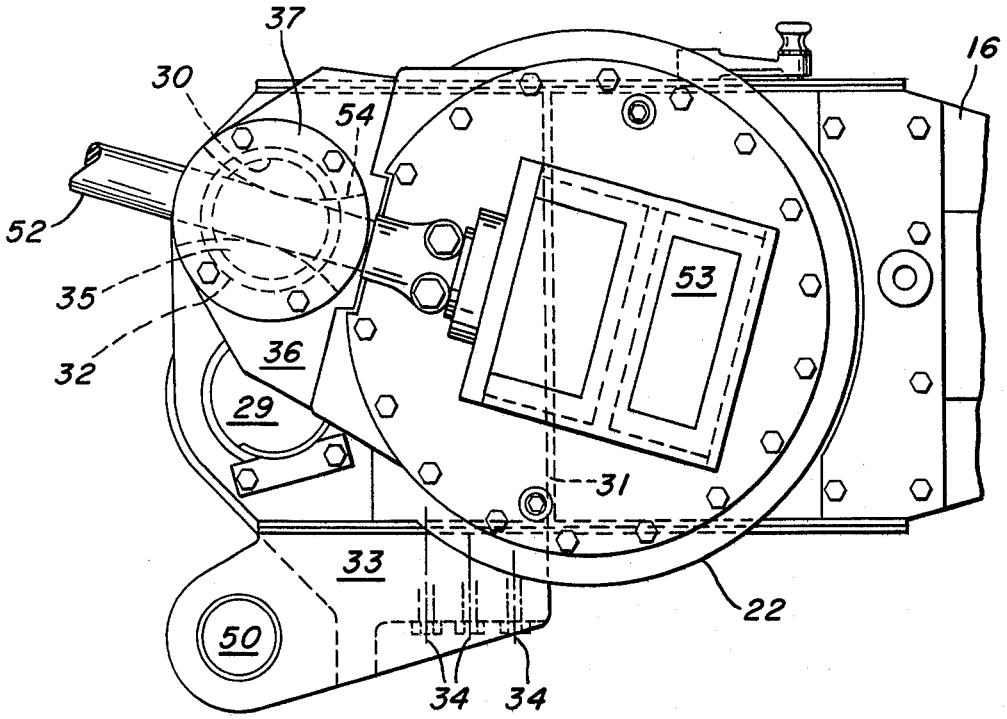
FIG. 5 is an elevational view of the support arm shown in FIG. 4.

The cutter cable 12 which is situated in the cable chain 13 enters the casing 9 of the machine body at 51. Separate cable portions 52 extend from the opposite ends of casing 9 and are connected to the motor casings 21 and 22. Each cable portion 52 extends into a cable entry 53 located in the end face of each casing 21 and 22 at the stow side. The cable portion 52 is passed through a diametrically-extended slot 54 in the stow side end of shaft member 40. Retaining members 37 are detachably mounted onto bearing members 36 of the casings 21 and 22 and cover the bores 35 of the bearing members. The opening 54 flares toward the ends as shown in FIG. 5 to accommodate the cable portion 52. Pivoting motions by the support arms do not cause a shift of the cable portion 52 in relation to the retaining members 37.

The casings 21 and 22 are designed for connection to support arm 15 or 16 in different positions and thereby maintain interchangeability of the support arms 15 and 16 and their pivotal connection by an optional arrangement at one or the other ends of the machine body. The casings are flange-mounted in different positions produced by rotating the casings about the longitudinal axis of their cylindrical bore so that the opening of the cable entry 53 faces the retaining member 37 (FIG. 5). After the casing is located into the desired position, bolt-type fasteners are used to secure the casing onto the support arm. The cable portions 52 are then extended over the shortest distance which is substantially rectilinear from cable entry 53 to the casing 9 of the drum cutter 1.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A drum cutter to release coal from a mine face while traveling along a mine floor, said drum cutter including the combination of:

a machine body including a pivot shaft at each of opposed ends thereof, the pivot shafts extending parallel to the mine floor at right angles to the direction of travel by the machine body therealong, two support arms each having two laterally-spaced bores at one end thereof extending transversely to the extended length of the support arm, each bore in the end of each support arm being adapted to selectively receive a pivot shaft at one end of the machine body for pivotal support thereby, a lever releasably mounted onto each of said support arms adjacent the ends thereof having said space bores, a cutter drum projecting from the free end of each of said two support arms at the coal side of the machine body for releasing coal from the mine face, jack means supported by said machine body and operatively coupled to a lever for pivoting a support arm to position a cutter drum supported thereby, and motor means supported on each support arm at the stow side, the extended ends of the motor means being supported to said pivot shafts.

2. The drum cutter according to claim 1 wherein said lever and said jack means are interchangeable with lever and jack means having different lengths.

3. The drum cutter according to claim 1 wherein said machine body at each of the opposed ends includes a recess in the plane of said lever to accommodate said jack means.

4. The drum cutter according to claim 1 wherein said two laterally-spaced bores in each support arm are superjacent bores in a mirror-image configuration about a plane of symmetry extending generally between the rotational axes of said cutter drum and said motor means.

5. The drum cutter according to claim 4 wherein each support arm includes means for attaching said lever at each of two positions at mirror-image positions relative to said plane of symmetry.

6. The drum cutter according to claim 1 wherein said support arms each incudes a perpendicular recess extending the height of the arm and intersecting said two laterally-spaced bores at one end thereof, and wherein said lever includes a portion extending into said recess and including two bores corresponding to said two laterally-spaced bores at one end of each support arm.

7. The drum cutter according to claim 6 further comprising a mounting shaft received in aligned bores in said lever and said arm while the same are interconnected by a pivot shaft in the other aligned bores.

8. The drum cutter according to claim 1 further including a casing detachably carried by each support arm on the stow side adjacent the pivot shaft engaging the arms, said casing having a cylindrical bore to house said motor means, fastener means to secure said casing at different positions produced by rotation thereof about the axis of said cylindrical bore, and means carried by the support shaft engaging the support arm to support the projecting end of said casing at a distallyspaced location from said support arm.

9. The drum cutter according to claim 1 wherein said machine body includes an extension at each of the opposed ends thereof, each extension having a common bore to non-rotatably mount two shaft members defining said pivot shaft, the shaft members projecting from opposite sides of the extension, the projecting portion of one shaft member extending through one of said two laterally-spaced bores in a support arm, said drum cutter further including lug means detachably mounted onto said machine body at the working face side thereof, said lug means having a bore to receive the end of the shaft member projecting from the support arm for retaining the latter engaged with the shaft member.

10. The drum cutter according to claim 9 further including a casing extending from each support arm at the stow side thereof to house said motor means, a bearing member detachably mounted onto the projected end of each casing, said bearing member having a bore to receive an end of a shaft member projecting from the extension of the machine body for supporting the casing.

11. The drum cutter according to claim 10 further including cable means extending from each motor means to said machine body, a retaining member detachably mounted onto said bearing member to cover said bore therein, the end of said shaft member engaged by said retaining member having a diametrically-extending opening to receive a portion of said cable means.

* * * * *